United States Patent [19]

Mohr

[11] Patent Number: 4,539,456

[45] Date of Patent: Sep. 3, 1985

[54] INDUCTION HEATING SYSTEM AND METHOD OF BONDING CONTAINER END UNIT TO BODY UTILIZING THE SAME

[75] Inventor: Glenn R. Mohr, Linthicum, Md.

[73] Assignee: Continental Can Company, Inc., Stamford, Conn.

[21] Appl. No.: 465,416

[22] Filed: Feb. 10, 1983

[51] Int. Cl.[3] ..... H05B 6/40

[52] U.S. Cl. ..... 219/10.69; 219/10.43; 219/10.53; 219/10.79; 156/274.2; 156/379.6

[58] Field of Search ..... 219/10.53, 10.41, 10.43, 219/10.57, 10.69, 10.71, 10.73, 10.79; 156/272.2, 273.7, 273.9, 274.2, 275.3, 275.7, 379.6, 380.1, 380.2, 380.6

[56] References Cited

U.S. PATENT DOCUMENTS

| | | | |
|---|---|---|---|
| 2,542,702 | 2/1951 | Prow | 219/10.53 |
| 2,937,481 | 5/1960 | Palmer | 219/10.53 X |
| 3,083,285 | 3/1963 | Haimbaugh et al. | 219/10.69 |
| 3,604,880 | 9/1971 | O'Neill | 219/10.53 |
| 4,237,360 | 12/1980 | Pohlenz | 219/10.41 |
| 4,340,801 | 7/1982 | Ishibashi et al. | 219/10.71 |
| 4,363,946 | 12/1982 | Busemann | 219/10.43 X |

*Primary Examiner*—Philip H. Leung

*Attorney, Agent, or Firm*—Charles E. Brown

[57] ABSTRACT

This relates to an induction heating apparatus which is particularly constructed and configurated so as to induce electrical current into a cylindrical portion of a member while the member moves along a path and is free of being rotated. The induction heading apparatus, by applying a uniform circumferential heating current, permits the device being heated to be pressed down into position relative to a companion device. The apparatus particularly relates to the heating of a heat softenable adhesive joining together telescoped cylindrical portions of a container and the proper seating of the upper container end unit on the container body and assures a uniform bond between the telescoped portions. This abstract forms no part of the specification of this application and is not to be construed as limiting the claims of the application.

8 Claims, 12 Drawing Figures

30
32
34
38
24
26
88
78
80
64
58
54
3
2
84
74
72
42
48
50
46
60
40
36

INDUCTION HEATING SYSTEM AND METHOD OF BONDING CONTAINER END UNIT TO BODY UTILIZING THE SAME

In accordance with this invention, an end unit having a lower cylindrical portion is telescoped over an upper cylindrical portion of a container body and the two are bonded together by a heat softenable adhesive such as a hot melt adhesive. In the initial assembling of the end unit and body, the end unit is not pressed to its final position with respect to the body during the application of the end unit. Accordingly, after initial assembly it is necessary to soften the adhesive by heating and finally to press the end unit into position relative to the body so that all resultant containers will be of the same height.

In the past, the adhesive has been softened by induction heating of the end unit. However, with all known past induction heating apparatus, it has been necessary to rotate the assembled container so as to provide for a like heating of all of the adhesive uniformly about the circumference of the end unit. Since the end unit must be pushed into final position relative to the body while the adhesive is still soft enough to permit such relative movement, the necessity of rotating the end unit poses a serious practical manufacturing problem.

It is very desirable to soften the adhesive and to press the end unit to its final position while the softened adhesive is still heated. It is further highly desirable that the end unit not be rotated at the time it is being heated. However, the uniform softening of the adhesive is a requirement of a good joint between the end unit and the body.

This invention in particular relates to the provision of a novel induction heating apparatus wherein the cylindrical strip of adhesive disposed between the telescoped portions of the end unit may be induction heated to a substantially uniform temperature throughout its circumference while the assembled body and end unit move along a straight path and are not being rotated. This invention particularly relates to the formation of conductors which are part of high frequency induction heating coils which are so configurated wherein a circumferential flow of electrical current is induced into the end unit notwithstanding the fact that the conductors for the electrical current are in the form of elongated strips.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 8, 10, 11, 12:
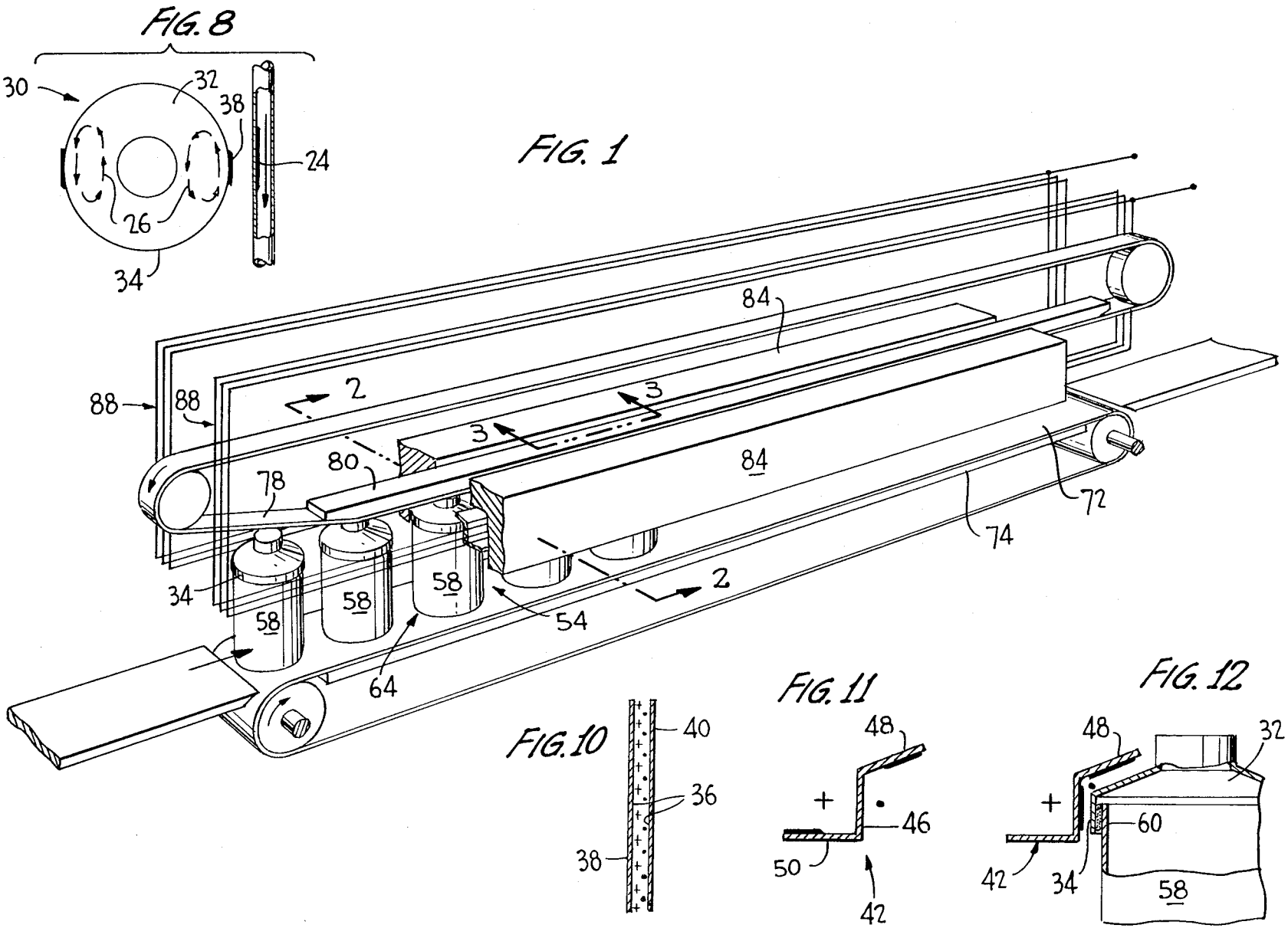
FIG. 1 is a top schematic perspective view of a container assembling apparatus formed in accordance with this invention.
FIG. 8 is a schematic plan view showing the arrangement of induced current flow in an end unit utilizing the conductors of FIG. 7.
FIG. 10 is a schematic sectional view similar to FIG. 9, but with the wide conductors closely spaced.

FIG. 11 generally indicates current flow on a generally S-shaped conductor utilized in accordance with this invention without a conductor being within the proximity of the conductor.

FIG. 12 is a schematic sectional view similar to FIG. 11, showing a container positioned relative to the conductors and the change in current flow pattern.

Figure 7:
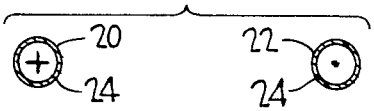
FIG. 7 is a schematic sectional view taken through two circular conductors, and shows the current flowing thereon.

Referring now first to the schematic illustration of FIG. 7 wherein the conductors are in the form of two tubes 20, 22 and the tubes are widely spaced as they would be if an end unit is to be positioned therebetween, it will be seen that in the absence of an end unit or container the current 24 flows on the entire circumference of the conductors 20, 22.

On the other hand, with reference to FIG. 8, it will be seen that when an end unit is passed between the conductors 20, 22, there will be a concentration of the current 24 on the conductors facing the end unit, which end unit is generally identified by the numeral 30, and there will be two circular patterns of induced current flow on the dome or top wall portion 32 of the end unit. These current patterns are generally oval in outline and are identified by the numeral 26. There will also be a concentration of current as at 28 on a lower cylindrical portion 34 of the end unit. It will be readily apparent that there can be no uniform heating circumferentially of the cylindrical portion 34.

Figure 9:
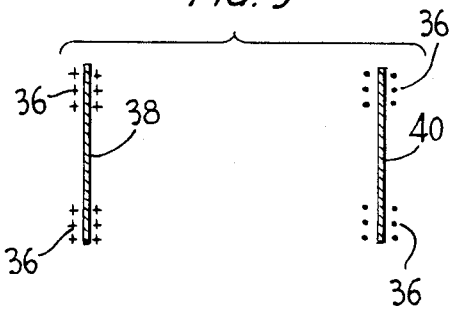
FIG. 9 is a schematic sectional view showing current flow on the conductors when the conductors are wide elements.

Referring now to FIG. 9 wherein the conductors are in the form of plates which are in upstanding parallel relation, it will be seen that the current flow 36 is on the edges of the plates 38, 40. On the other hand, if the plates 38, 40 are moved closely adjacent each other, the current flow 36 now is on the inner surfaces only of the conductors or plates 38, 40 with there being even distribution.

If the end unit 30 is passed between the plate-like conductors 38, 40 when spaced sufficiently to permit the passage of an end unit therebetween, there once again will be uneven heating of the cylindrical portion 34 of the end unit.

It has been found in accordance with this invention that the conductors should be generally of an S-shape. Such conductors 42, 44 are shown in FIG. 11. Each conductor 42, 44 will include an upstanding central band-like portion 46. Extending from the upper edge of the first portion 46 is a second portion 48 in the form of another band which slopes upwardly and away from the first portion 46. There is carried by the first portion 46 at the lower edge thereof a third portion 50 in the form of a band-like portion which extends generally horizontally from the first portion 46 in the opposite direction from the second portion 48.

Current flow on the conductors 42, 44, in the absence of an end unit, will be concentrated on the extreme end portions of the conductors generally as in the case of the conductors 38, 40. On the other hand, with reference to FIG. 12, it will be seen that when an end unit is present, the current flow on the third portion 50 will cease and the current flow will be on the inner surfaces of the portions 46 and 48.

At this time it is pointed out that it is preferred that the slope of the second conductor portion 48 correspond generally to the slope of the dome 32 of the end unit 30.

Figure 4:
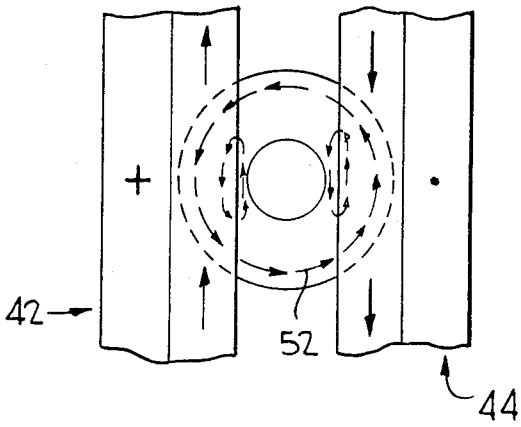
FIG. 4 is a fragmentary top plan view of an intermediate portion of the apparatus, and diagrammatically shows current flow both in the conductors and in the end unit.

Referring now to the schematic showing of FIG. 4, it will be seen that with the current flowing in opposite directions along the conductors 42, 44, current will be induced into the end unit 30 in the opposite direction with there being a complete circumferential flow of induced current 52 in the opposite direction. This will result in uniform heating of the cylindrical portion 34 about the circumference thereof.

Figure 2:
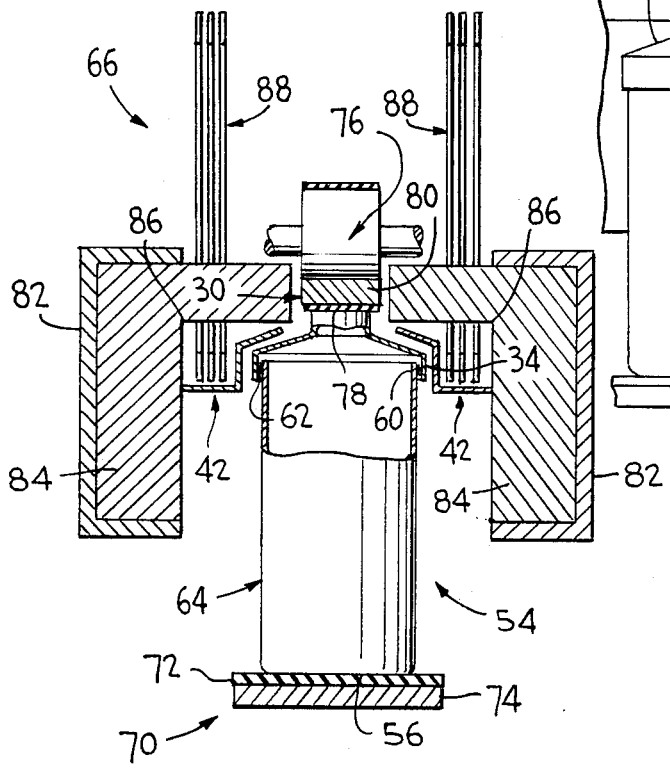
FIG. 2 is a transverse vertical sectional view taken generally along the line 2—2 of FIG. 1.

As is best shown in FIG. 2, each end unit 30 is applied to a tubular body 54, which is in the form of a one-piece can body including a bottom 56 and a body member 58. The cylindrical portion 34 of the end unit is telescoped over an upper cylindrical end portion 60 of the container body 54 with there being a band of adhesive 62 disposed between the telescoped cylindrical portions 60 and 34.

It is to be understood that the end unit 30 has already been initially assembled with the container body 54, but the cylindrical portions 34, 60 are not fully telescoped. In accordance with this invention, the adhesive 62 which is a heat softenable material such as a hot melt adhesive, has to be reheated and softened to the point wherein the end unit 30 is movable relative to the body 54 and the end unit 30 may be controllably further telescoped relative to the body 54 by pressing the end unit down so that the resultant container 64 will be of a preselected height and by uniformly circumferentially heating the adhesive 62, a completely uniform bond may be obtained.

Figure 3:
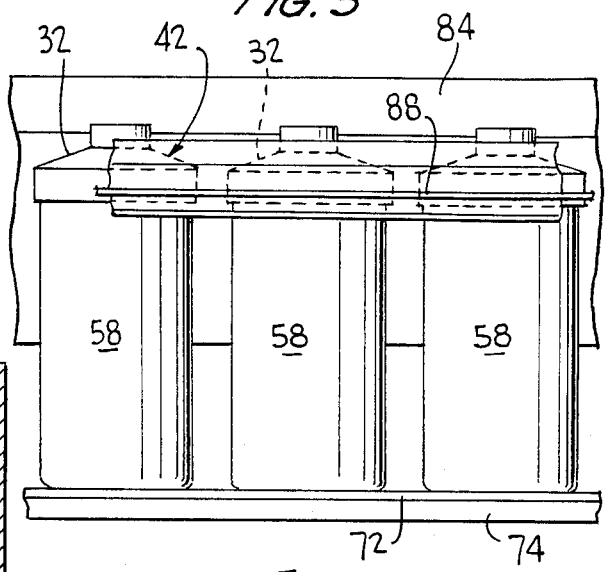
FIG. 3 is a fragmentary longitudinal sectional view taken generally along the line 3—3 of FIG. 1.

In the preferred embodiment of FIGS. 1–3, the apparatus is generally identified by the numeral 66 and includes a supporting frame 68. The frame 68 carries a lower endless conveyor 70 having an upper run 72 which preferably slides on a support 74.

There is an upper conveyor belt 76 having a lower run 78 which is positioned to engage the tops of the domes or end units 30 to exert a downward force thereon. The lower run 78 runs beneath a force applying guide 80.

The support 68 suitably carries ferrite supports 82 on opposite sides of the path of the upper part of the containers 64. The ferrite supports 82 carry ferrite blocks 84 of a generally inverted L-shape arrangement with each block assembly 84 defining an inner and downwardly facing corner 86 on which there is seated one of the conductors 42. It will be seen that the conductors 42 are related to the moving end units 30 in the manner specifically shown in FIG. 12.

In this preferred embodiment of the invention, each of the conductors 42 is associated with a separate multiple turn coil 88 which is formed of flattened copper tubing and which has a cooling supply coupled thereto in a known manner for circulating a coolant therethrough. It will be noted that runs of each multiple turn coil 88 are seated in the corner between the conductor portions 46, 50 and also generally within the corner 86 defined by the assembly of blocks 84. Further, each coil 88 has an upper return run 90.

It is to be understood that appropriate portions of the coils 88 will be provided with suitable insulation, and therefore the exposed portions of the coils 88 will in no way be harmful.

Figure 5:
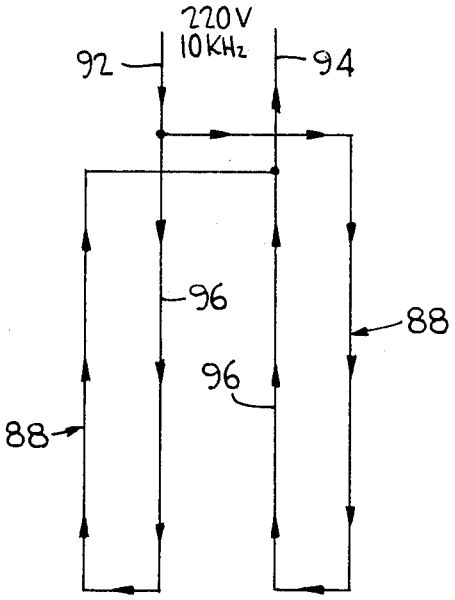
FIG. 5 is a wiring schematic for the apparatus.

Referring now to FIG. 5, it will be seen that there is illustrated a wiring schematic for the double coil arrangement. In this figure, the individual coils 88 are illustrated as being single turn coils, although it is to be understood that each of the coils will, in substantially all installations, be of the above-described multiple turn construction.

The coils 88 are connected to leads 92, 94 of a 220 volt 10 kHz electrical supply, with the current flowing in each coil in a clockwise direction, but wherein adjacent runs 96 of the two coils have current flowing therein in opposite directions as is schematically illustrated in FIG. 4.

Figure 6:
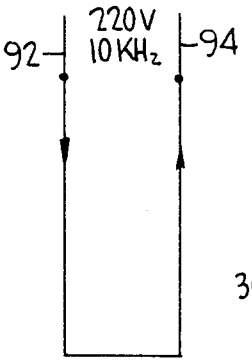
FIG. 6 is a modified wiring schematic when the two conductors are portions of a single coil.

At this time it is pointed out that it is feasible to use a single coil construction, as shown in FIG. 6. However, the dual coil construction of FIGS. 2 and 5 has the advantage in that each of the two coils 88 may be individually adjusted, whereas if a single coil is utilized and that coil does have a certain degree of rigidity, then adjustment of the conductors 42 relative to each other will be more difficult.

It has been surprisingly found, as shown in FIG. 4, that in lieu of the concentrated current flow as shown in FIG. 8 using conventional conductors, when the specific conductors of FIG. 12 are utilized, current flow in the end unit 30 is circumferential, as shown in FIG. 4, with the previously applied adhesive 62 being uniformly and controllably heated so as to be softened to the degree which permits not only the proper seating of the end unit 30 on the container body 54, but also the softening of the adhesive to the extent that it is flowable and assures a uniformity of the bond between the telescoped cylindrical portions 34, 60.

By being able uniformly to heat the adhesive 62 without rotating the containers 64, it is feasible to heat the container while a downward pressure is being applied on the end unit utilizing the conveyor 76. It will be noted that the force applying member 80 does not extend the full length of the lower run 78 of the conveyor 76 and this permits an initial heating of the adhesive 62 before a force sufficient to effect telescoping of the end unit relative to the container body 54 is applied.

It is to be understood that the apparatus 66 is preferably mounted in a container forming line with an apparatus that applies the adhesive to the end unit 30 and then applies the end unit 30 to the container body 54 with the container bodies 54 moving in a straight line and being uniformly spaced. If desired, the conveyor 70 may run through the machine which applies the end units to the container bodies.

Although only a preferred embodiment of the invention has been specifically illustrated and described herein, it is to be understood that minor variations may be made in the induction heating apparatus and the utilization thereof without departing from the spirit and scope of the invention as defined by the appended claims.

I claim:

1. An inductance heating apparatus for heating moving cylindrical surfaces, said apparatus comprising conveyor means for moving cylindrical surfaces along a preselected path, conductors positioned along said path, said conductors being of an angular cross section and each conductor having a first portion positioned to be disposed alongside a moving cylindrical surface and a second portion positioned to overlie a portion of the same moving cylindrical surface, said conductors each being a portion of a coil, and a source of high frequency electrical energy coupled to said conductors, each of said conductors including a lower third conductor portion extending from said first conductor portion in a direction generally opposite to that of said second conductor portion.

2. A heating apparatus according to claim 1 wherein said apparatus is particularly adapted to heat members each having a lower cylindrical portion and an upper dome portion, and said second conductor portion being angled relative to said first conductor portion to be substantially parallel to a member dome portion.

3. A heating apparatus according to claim 1 wherein said coil includes a segment seated alongside said first conductor portion and generally on said third conductor portion.

4. A heating apparatus according to claim 1 wherein said conductors are parts of two separate coils.

5. A heating apparatus according to claim 1 wherein each conductor is seated in a corner defined by an inverted L-shaped ferrite support.

6. A heating apparatus according to claim 1 wherein there is a constantly moving conveyor for moving upstanding tubular bodies carrying members having said cylindrical surfaces between said conductors, and there are pressure means overlying said members for pressing said members down on said tubular bodies.

7. A heating apparatus according to claim 1 wherein each of said conductors is formed of sheet metal.

8. A method of heating a cylindrical skirt portion of an inverted cup-shaped member having an end wall, said method comprising the steps of providing a pair of spaced parallel sheet metal conductors forming part of a high frequency induction coil assembly, conveying the members serially between the conductors along a path with each sheet metal conductor having a first portion extending longitudinally of the path alongside the member skirt portion and a second portion overlying an outer part of the member end wall, and generally advancing the members in absence of rotation.

* * * * *